US006031165A

United States Patent [19]

Brekke

[11] Patent Number: 6,031,165

[45] Date of Patent: Feb. 29, 2000

[54] ADJUSTABLE BRIDGE FOR USE WITH A STRINGED INSTRUMENT

[76] Inventor: Vernon A. Brekke, 3620 Prairie Smoke Rd., Bozeman, Mont. 59715

[21] Appl. No.: 09/292,874

[22] Filed: Apr. 16, 1999

Related U.S. Application Data

[60] Provisional application No. 60/082,212, Apr. 17, 1998.

[51] Int. Cl.[7] ..... G10D 3/04

[52] U.S. Cl. ..... 84/298; 84/307

[58] Field of Search ..... 84/298, 307, 267, 84/299

[56] References Cited

U.S. PATENT DOCUMENTS 3,563,126 2/1971 Connington ..... 84/298

5,271,307 12/1993 Pollock ..... 84/298

*Primary Examiner*—Robert E. Nappi

*Assistant Examiner*—Shih-yung Hsieh

*Attorney, Agent, or Firm*—Richard C. Conover

[57] ABSTRACT

An adjustable bridge, according to the present invention, includes a bridge base having a lower edge shaped to conform to the top surface of the sound box of the instrument with which the bridge is to be used. The base includes an elongate fitting slot located at a top edge of the base. The fitting slot having a longitudinal axis extending in a direction substantially perpendicular to strings of a stringed instrument. Each end of the elongate slot has an inclined surface extending downwardly and away from the base. A saddle is also provided, which is sized to fit snugly within the slot of the base. The bottom edge of the saddle is shaped at both ends with an inclined surface which extends upwardly and away from the saddle. A pair of wedges are positioned in the slot of the base between the base and the saddle. Each wedge has an upper edge which conforms with the inclined surface of the saddle, and a lower edge which conforms with the inclined surface of the base. A pair of set screws are mounted in the ends of the base. The set screws are positioned to engage an outer edge of the wedge to drive the wedge between the saddle and the bridge base. By moving the wedges, the height of the saddle with respect to the bridge base, can be adjusted.

6 Claims, 3 Drawing Sheets

ADJUSTABLE BRIDGE FOR USE WITH A STRINGED INSTRUMENT

This application claims benefit of provisional application Ser. No. 60/082,212 filed Apr. 17, 1998.

BACKGROUND

The present invention relates to an adjustable bridge that is used to raise or lower all of the strings on a stringed instrument at the same time relative to the instrument frets even when the strings are under tension from tuning.

Sound production from stringed instruments is almost always accomplished in one of two ways. In the first case, at least one microphone type sensor is used to pick up string vibrations electrically where these electrical vibrations can then be amplified electrically. An electric guitar exemplifies this first case. In the second case, a vibratory sound path is provided that originates with the vibrating strings, passing through a bridge supporting the strings to the top surface of a hollow sound box which amplifies the vibrations mechanically. Acoustic instruments such as guitars, mandolins and violins exemplify this second case. The two cases present different structural limitations for adjustable bridges, because in the first case, little concern has to be given to providing a vibratory sound path between the strings and a sound box. Acoustic instruments require a bridge which does not inhibit this sound path.

In both types of musical instruments, bridges are important in setting the distance of the strings over the instrument fret-board. Adjusting the height of the strings above the fret-board is important for the playability of the instrument, and to prevent string buzzing.

Adjustable bridges having screw adjustments have often been used in the past to adjust the string height above the instrument fret-board, as shown in U.S. Pat. No. 4,248,126 or U.S. Pat. No. 4,334,454. Both of these patents show adjustable bridges for use with electric guitars.

U.S. Pat. No. 5,600,078 shows another adjustable bridge for use with an electrical guitar where an adjustable member slides up an inclined plane to adjust the string height of an individual string.

A need exists for an adjustable bridge for use with a stringed acoustic instrument, where the sound produced by the strings is transmitted through the bridge to the top surface of the sound box. Such bridge needs to have the capability of easily adjusting the height of all the strings over the fret-board at the same time, while the instrument strings are under tension.

SUMMARY OF INVENTION

An adjustable bridge, according to the present invention, includes a bridge base having a lower edge shaped to conform to the top surface of the sound box of the instrument with which the bridge is to be used. The base includes an elongate fitting slot located at a top edge of the base. The fitting slot having a longitudinal axis extending in a direction substantially perpendicular to strings of a stringed instrument. Each end of the elongate slot has an inclined surface extending downwardly and away from the base. A saddle is also provided, which is sized to fit snugly within the slot of the base. The bottom edge of the saddle is shaped at both ends with an inclined surface which extends upwardly and away from the saddle. A pair of wedges are positioned in the slot of the base between the base and the saddle. Each wedge has an upper edge which conforms with the inclined surface of the saddle, and a lower edge which conforms with the inclined surface of the base. A pair of set screws are mounted in the ends of the base. The set screws are positioned to engage an outer edge of the wedge to drive the wedge between the saddle and the bridge base. By moving the wedges, the height of the saddle with respect to the bridge base, can be adjusted.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
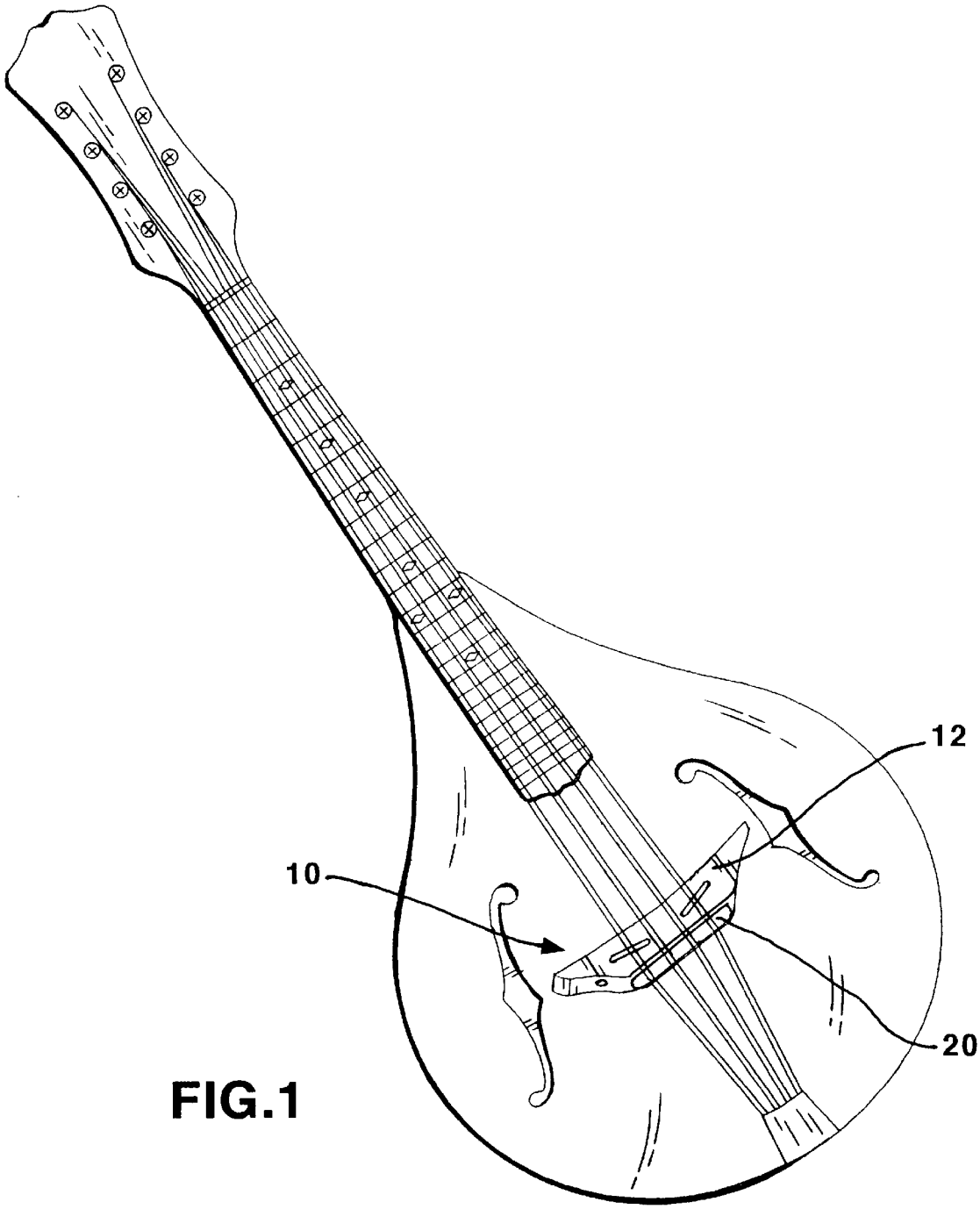
FIG. 1 is an elevational view of a conventional mandolin with the adjustable bridge of the present invention shown in perspective.
Figure 3:
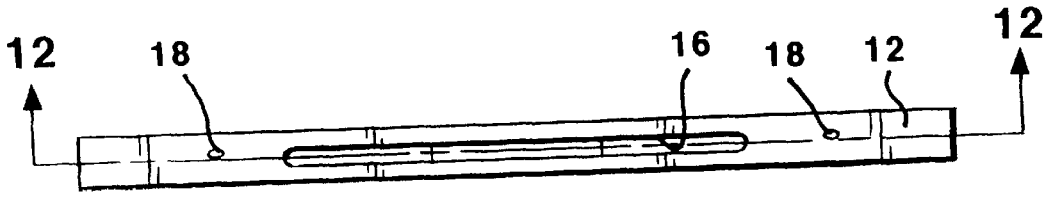
FIG. 3 is a top plan view of the adjustable bridge base shown in FIG. 2.
Figure 2:
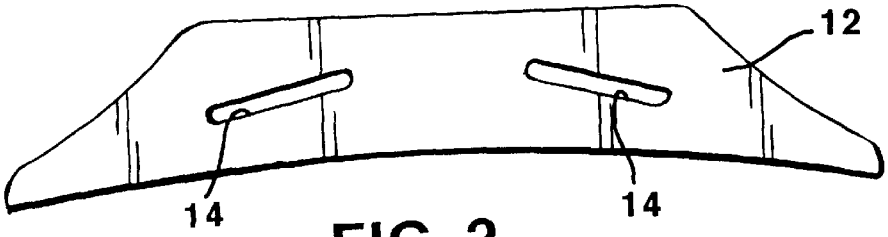
FIG. 2 is an elevational view of an adjustable bridge base as shown in FIG. 1.

As seen in FIG. 1, a stringed instrument adjustable bridge 10 is provided on a sound box of a conventional stringed instrument where the sound produced by the strings is passed through the bridge to the sound box. The strings of the stringed instrument are conventionally aligned in a substantially parallel relation.

Adjustable bridge 10 includes an elongate bridge base 12 as shown in FIGS. 2, 3, 4, 11 and 12. The lower surface of base 12 is shaped to conform to the shape of the top surface of the sound box of the instrument with which the bridge is to be used. This shaping enhances the sound transmission through the bridge to the sound box. The bridge base 12 is positioned on the top surface of the soundbox at a position generally perpendicular to the strings of the instrument.

Figure 12:
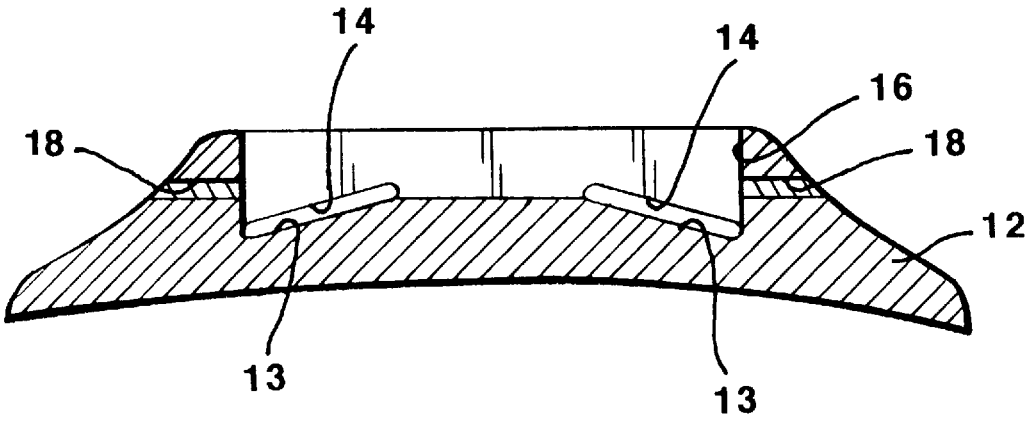
FIG. 12 is a cross-sectioned view along the line 12—12 in FIG. 3.

At the top of base 12, an elongate fitting slot 16 is provided having a longitudinal axis. In a preferred embodiment, this slot has a length at least as great as the transverse distance across the parallel arranged strings, and has a depth approximately midway through the interior of base 12, as shown in FIG. 12. The bottom wall of the fitting slot is shaped to have an inclined plane 13 located at each end of the fitting slot, each of which extends downwardly and outwardly, as shown in FIG. 12.

Figure 11:
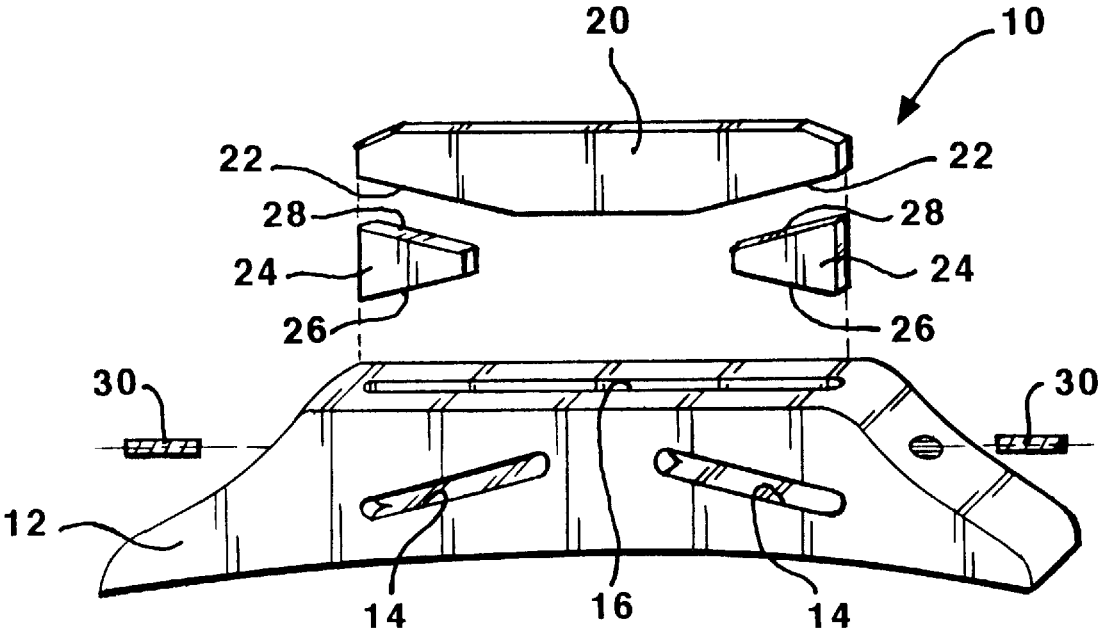
FIG. 11 is an exploded view of the adjustable bridge shown in FIG. 1.

Observation slots 14 are provided in base 12, as shown in FIGS. 11 and 12. Each slot 14 extends transversely and entirely through base 12. The slots 14 run parallel to a respective inclined plane 13 of the bottom wall of the fitting slot 16 and extend from the fitting slot at a position adjacent an inclined plane 13 to the exterior of the base 12.

Figure 4:
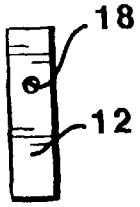
FIG. 4 is a right side view of the adjustable bridge base shown in FIG. 2.
Figure 6:
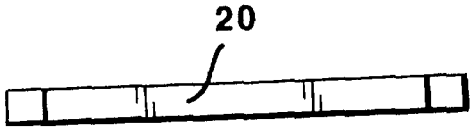
FIG. 6 is a top plan view of the adjustable bridge saddle shown in FIG. 5.

Threaded bores 18 are provided at each end of base 12, and extend from an external side surface of base 12 through the base 12 to the slot 16 in a direction substantially parallel to the longitudinal axis of the fitting slot, as shown in FIGS. 4 and 12.

Figure 5:
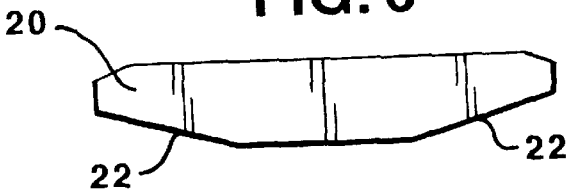
FIG. 5 is an elevational view of an adjustable bridge saddle shown in FIG. 1.
Figure 7:
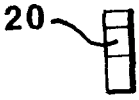
FIG. 7 is a right side view of the adjustable bridge saddle shown in FIG. 5.
Figure 9:
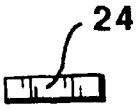
FIG. 9 is a top plan view of the adjustable bridge wedge shown in FIG. 8.
Figure 8:
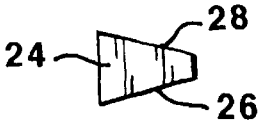
FIG. 8 is an elevational view of an adjustable bridge wedge.
Figure 10:
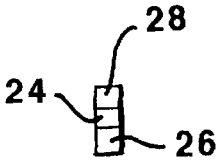
FIG. 10 is a right side view of the adjustable bridge wedge shown in FIG. 8.

A saddle 20, which is sized to fit snugly within slot 16, is positioned within the slot, as shown in FIG. 1. Saddle 20 has a length at least as great as the transverse distance across the parallel arranged strings. The bottom edge of saddle 20 has inclined surfaces 22 provided at each end of saddle 20. These inclined surfaces are inclined upwardly and away from saddle 20, as shown in FIGS. 5 and 11.

Wedges 24, as shown in FIG. 11 and FIGS. 8–10, are sized in thickness to fit within slot 16. The bottom edge 26 of wedge 24 is shaped to conform with the inclined surface 13. The upper edge 28 of wedge 24 is shaped to conform to inclined surface 22 of saddle 20.

As shown in FIG. 11, the wedges 24 are positioned on opposite sides of slot 16, so as to ride along the inclined surfaces 13 of base 12. Saddle 20 is then placed in slot 16 so that inclined plane surfaces 22 on the saddle ride against the corresponding surfaces 28 of wedges 24.

Set screws 30 are threaded into threaded bores 18 to bear against wedges 24. As set screws 30 are turned by a screwdriver, they reposition wedges 24 in slot 16, which in turn raises or lowers saddle 20. The amount of adjustment applied can be determined by noticing the position of wedges 24 in observation slots 14.

In operation, the distance between the strings and the fret-board can be adjusted using adjustable bridge 10. Set screws 30 are tightened, or loosened, as necessary to adjust the distance between the strings and the instrument frets. Set screws 30 are reached by using a screwdriver oriented in a direction perpendicular to the strings to provide easy access for this adjustment. The amount of adjustment applied is determined by looking in observation slots 14 and noticing the position of wedges 24. The sound produced by the strings is then transported through the saddle 20, and base 12, to the sound box. The saddle 20 adjusts all of the strings of the stringed instrument at one time.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims.

I claim:

1. An adjustable bridge for use with a stringed instrument having a sound box and multiple strings aligned in substantially parallel relation comprising:

an elongate bridge base having a portion of a bottom edge shaped to conform to a top external surface of the sound box;

the base having an elongate fitting slot of predetermined width located at a top edge of the base, the fitting slot having length and extending in a direction substantially perpendicular to the strings;

an elongate saddle having a width substantially the same as the width of the slot and positioned in the slot;

a wedge means positioned in the slot between the saddle and the base for movement in a direction along the length of the fitting slot for separating the saddle from the base a distance determined by the position of the wedge means along the length of the fitting slot; and adjustment means included in the base for moving the wedge means along the length of the fitting slot.

2. An adjustable bridge according to claim 1 wherein a bottom wall of the fitting slot is shaped to have an inclined surface plane located at each end of the fitting slot, the inclined surface plane extending downwardly and away with respect to the base; and wherein the wedge means comprises a pair of wedges, each wedge having a lower edge shaped to conform to the corresponding inclined surface plane of the fitting slot, and wherein each wedge is positioned within the fitting slot at an end of the fitting slot with the inclined surface plane of the wedge resting on the corresponding inclined surface plane of the base.

3. An adjustable bridge of claim 1 wherein the bottom edge of the saddle is shaped to have an inclined surface plane located at each end of the saddle, the inclined surface plane extending upwardly and away with respect to the saddle; and wherein the wedge means includes a pair of wedges, each wedge having an upper edge shaped to conform to the respective inclined surface plane of the saddle, and wherein each wedge is positioned within the fitting slot at an end of the fitting slot with the inclined surface plane of the wedge resting against the inclined surface plane of the saddle.

4. The adjustable bridge of claim 1 wherein an observational slot is provided which runs parallel to a bottom wall of the fitting slot, and extends from the fitting slot, to the exterior of the base.

5. The adjustable bridge of claim 1 wherein the base includes a threaded bore positioned at an end of the base adjacent an end of the fitting slot, the threaded bore extending from an exterior surface of the base, through the base and into the fitting slot, and wherein the adjustment means includes a set screw threadably received by the threaded bore for abutting engagement with an edge of the wedge positioned adjacent an end of the fitting slot.

6. The adjustable bridge of claim 1 wherein the saddle has a length at least as great as the transverse distance across the parallel arranged strings.

* * * * *